United States Patent [19]

Peppler

[11] 4,354,098

[45] Oct. 12, 1982

[54] EGG COUNTER

[75] Inventor: William Peppler, Athens, Ga.

[73] Assignee: Chore-Time Equipment, Inc., Milford, Ind.

[21] Appl. No.: 318,075

[22] Filed: Nov. 3, 1981

[51] Int. Cl.[3] ..... G06M 7/00

[52] U.S. Cl. ..... 235/98 B; 235/92 PK

[58] Field of Search ..... 235/98 R–98 C, 235/92 PK; 221/7, 8; 198/40

[56] References Cited

U.S. PATENT DOCUMENTS

| | | | |
|---|---|---|---|
| 2,730,301 | 1/1956 | Beamish | 235/98 B |
| 3,511,439 | 5/1970 | Swenson | 235/98 R |

*Primary Examiner*—Benjamin R. Fuller

*Attorney, Agent, or Firm*—Trexler, Bushnell & Wolters, Ltd.

[57] ABSTRACT

A counting apparatus is provided for producing a countable signal in response to each object moving past a predetermined point in a predetermined path of travel. This counting apparatus comprises a lever interposed in the path of travel substantially adjacent to the predetermined point and movable in a first direction in response to passage of at least a portion of an object past the predetermined point, where the portion of the object is of a size which is within a predetermined range of sizes. A switch having a first signal state and a second signal state, is operatively coupled to a further coupling arrangement with the switch for actuating the switch means to its first state in response to movement of the lever in the first direction. A resetting structure is also operatively coupled for resetting the lever and the switch so as to actuate the switch to its second state in response to a predetermined minimum incremental movement of the lever in a direction generally opposite said first direction in response to a predetermined minimum incremental decrease in the size of a portion of said object passing by said predetermined point along said path of travel.

16 Claims, 6 Drawing Figures

EGG COUNTER

BACKGROUND OF THE INVENTION

The present invention is directed generally to counting apparatus, and more particularly to apparatus for counting a plurality of objects, such as eggs, moving along a predetermined path.

While the present invention is useful over a broad range of applications, the disclosure will be facilitated by specific reference to the problem of counting eggs in a commercial egg-producing operation. Counting devices for this purpose are well known in the art. However, the counting devices heretofore in use have encountered some problems.

Specifically, it has heretofore proven difficult with mechanical counters to reliably count a relatively rapidly moving stream of eggs, as for example along a conveyor belt, when the size of the eggs varies by more than a relatively small amount. In this regard, a mechanical switching device can readily be set to count small eggs, or large eggs, but should a number of small eggs immediately follow a number of relatively large eggs down the conveyor belt, the small eggs tend not to be counted. This is true since a mechanical switch must be reset to its inactive or "off" state intermediate each actuation thereof to its active or "on" state by a passing egg.

In prior art systems, a lever is interposed in the path of travel of the eggs along the conveyor belt and is mechanically coupled to the switch for actuating the switch in response to the passage of each egg thereby. However, it will be seen that this lever must be set relatively high so as to permit the passage of relatively large eggs thereby. However, with the lever set relatively high, somewhat smaller eggs may readily pass thereunder without actuating the lever, thus failing to actuate the switch and hence not being counted. On the other hand, if the lever is set low enough to count relatively small eggs it wil impede the passage of relatively larger eggs which may result in damage to the lever, damage to the eggs or both, requiring costly and time consuming repair or readjustment of the counting apparatus, removal of damaged eggs, etc.

It is known to provide adjustment for such mechanical counters so that the average size egg being processed at a given time will cause actuation thereof. Accuracy is improved somewhat by this method, but still, problems can be encountered with the passage of eggs which are either significantly larger or significantly smaller than this average. The prior art has also attempted the use of photo-cell-based counters, which theoretically can produce a high degree of accuracy. However, the poultry house environment contains excessive airborne dust, dirt, and the like which tend to befoul the photo-cell elements, causing excessive maintenance problems.

OBJECTS AND SUMMARY OF THE INVENTION

Accordingly, it is a general object of this invention to provide a novel and improved counting apparatus.

A more specific object is to produce such a counting apparatus which is especially adapted for the counting of eggs passing along a conveyor belt or the like in a relatively large-scale egg-producing operation.

A more specific object is to provide an egg counter which is adapted to accurately and reliably count eggs over a surprisingly broad range of sizes.

A related object is to provide an egg counter which has a floating reset point, so that switch actuation and resetting occur within a predetermined minimum differential movement in response to the passage of eggs over a relatively broad range of sizes.

A related object is to provide an egg counter in accordance with the foregoing objects which is relatively simple and inexpensive to construct and yet highly reliable in operation.

Briefly, and in accordance with the foregoing, a counting apparatus in accordance with the invention comprises signalling means for producing a detectable signal in response to passage of at least a portion of an object past a predetermined part of a predetermined path of travel, said signalling means being responsive to objects at least a portion of which is of a size over a predetermined range of sizes, and resetting means for resetting said signalling means following the production of each signal thereby so as to enable production of a further signal thereby in response to passage of a subsequent object past said predetermined part of said path of travel, said resetting means being responsive to a predetermined minimum incremental decrease in the size of the portion of said object at said predetermined part of said path of travel for resetting said signalling means, without regard for the actual size of the object or any portion thereof within said range of sizes.

BRIEF DESCRIPTION OF THE DRAWINGS

The foregoing, as well as other objects, features and advantages of the invention will be more readily apparent upon reading the following detailed description of the illustrated embodiment together with reference to the accompanying drawings, wherein.

DETAILED DESCRIPTION OF THE ILLUSTRATED EMBODIMENT

Figure 1:
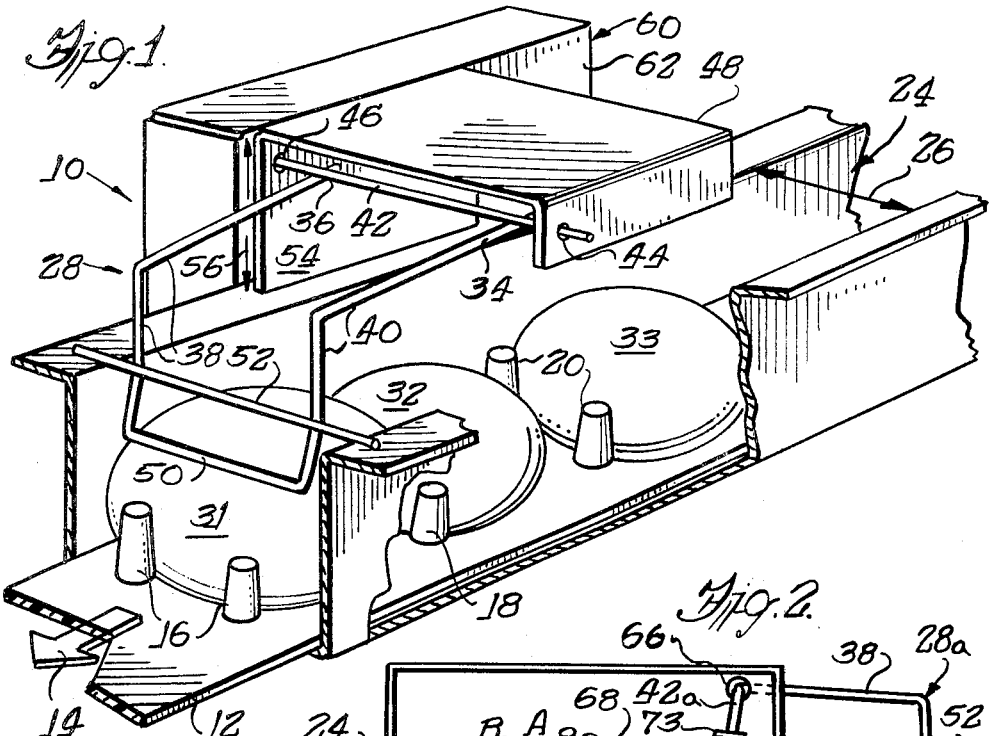
FIG. 1 is a perspective view, partially cut away, of a counting apparatus in accordance with the invention.

Referring now to the drawings and initially to FIG. 1, there is seen a counting apparatus in accordance with the invention and designated generally by the reference numeral 10. In order to facilitate description of the invention, the counting apparatus 10 of the illustrated embodiment comprises an egg counter. It will be understood that the principles of the invention are useful in counting objects other than eggs, and hence the invention is not limited to the illustrated egg counter.

In accordance with conventional practice, a conveyor belt 12 is driven by suitable means (not shown), in a direction 14. Upon this conveyor belt 12 a plurality of discreet, egg-carrying sections are formed, for example by a plurality of pairs of spaced apart, upwardly projecting fingers 16, 18, 20, etc. In accordance with conventional practice, these pairs of fingers 16, 18, etc., are spaced apart to define an area or compartment of sufficient size to receive but a single egg. Moreover, the area of the compartment confined by respective pairs of fingers 16, 18, etc., will readily accommodate a single egg over a relatively broad range of sizes from relatively small eggs to relatively large eggs. However, the structure of this conveyor 12 and the compartments therein formed by the fingers 16, 18, etc., or other suitable means form no part of the invention.

Also in accordance with conventional practice, this conveyor is preferably carried in a generally U-shaped guide structure or trough 24 which has an open top portion 26 of sufficient width to accommodate the conveyor 12.

Departing from convention and in accordance with the invention, a lever 28 is interposed in the path of travel defined by the conveyor belt 12 and trough 24 for engaging respective eggs 31, 32, 33, etc., as they pass a predetermined part of the path of travel adjacent the lever 28. In the illustrated embodiment, the lever 28 is constructed of relatively thin, light weight wire-like material formed into a generally U-shaped configuration. The terminal end parts 34, 36 of a pair of legs 38, 40 forming this U-shaped lever 28 are affixed in parallel and spaced apart condition by suitable means as by welding or the like to a transverse bar or rod 42. This rod 42 is rotatably mounted or journaled in suitable bearing apertures 44, 46 at opposite ends thereof, these apertures 44, 46 being carried in a suitable plate 48 which extends above the trough 24 and conveyor 12. Preferably, this plate 48 is spaced apart a substantially greater distance than the maximum dimension of any egg carried by the conveyor 12 so as to permit free passage of all eggs thereunder.

In order to interpose the lever 28, or at least a portion thereof in the path of travel of the eggs 31, 32, etc., the legs 38, 40 are bent downwardly at an angle approaching 90° so as to dispose the bottom leg or bar 50 of the "U", which joins the parallel and opposite legs 38 and 40, in the path of travel of the eggs 31, 32, etc.

In the illustrated embodiment, a further elongate rod 52 is coupled to the respective legs 38, 40 a predetermined distance above and parallel with the bottom or joining leg or bar 50. This rod 52 is of a greater length than the width across the open top 26 of the trough 24. Hence, a maximum intrusion of the leg 50 into the path of travel of the eggs 28, 30 is defined thereby. Preferably, the amount of intrusion of the leg 50 into the path of travel thus defined is sufficient to insure at least a minimum degree of upward deflection of the leg or bar 50 and hence of the entire lever structure 28 in response to the smallest size egg 28, 30, etc., expected to be encountered as the conveyor 12 moves under the lever 28. Preferably, the outer ends of legs 38, 40, beyond the rod 52 are bent or angled outwardly somewhat, to add a vertical component to the force of eggs encountering the bar 50 for initiating the lever action of the lever 28.

Figure 2:
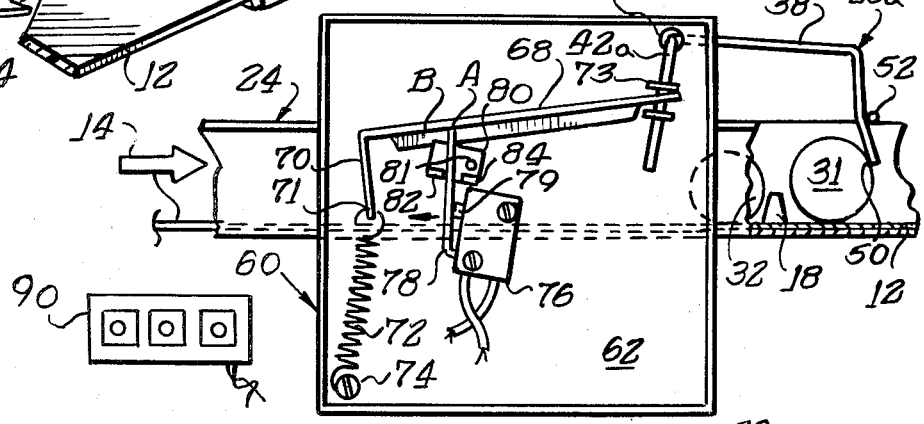
FIG. 2 is a partially cut away rear elevation of the counting apparatus of FIG. 1, illustrating further details thereof.

Reference is next invited to FIG. 2, wherein a further structure actuated in response to movement of the lever 28 by the passage of an egg thereby is illustrated. As viewed in FIG. 2, the plate 48 is coupled to a housing 60 which is in turn coupled to the side wall of the trough 24. In the illustrated embodiment, the spacing of the plate 48 is controlled by a downwardly bent end portion 54 thereof.

The vertical extent of this downwardly bent end portion 54 substantially abuts against a top edge of a side wall of the trough 24 to thereby position the plate 48 with respect thereto. At the same time, the housing 60, trough 24 and plate 48 are provided with means such as bolts, weldments, or the like (not shown) joining the housing 60, plate 48 and trough 24 in the relative positions illustrated.

The aperture 46 is in alignment with a similar through aperture 66 through the front wall 62 of the housing 60. The rod 42 extends through this aperture 66 as well whereupon it is bent downwardly at a substantially right angle, to define a portion 42*a* thereof, as illustrated in FIG. 2. Accordingly, while the lever 28 effectively fulcrums about a line through the portion of the bar 42 to which it is attached, this latter, bent over portion 42*a* of the bar 42 also fulcrums in unison therewith substantially about the same line, as defined by the apertures 44, 46 and 66. This latter rod part 42*a* is coupled with an elongate, bar slide or strip 68. This bar slide, or strip 68 is preferably formed from a relatively thin, flat sheet of relatively rigid metallic material. The bar or strip 68 is formed with a suitable aperture for slidably receiving the rod 42*a* in one end thereof, while at the opposite end it is bent over at substantially 90° to form an extension part 70.

The extension 70 has a suitable aperture 71 or other means at the end thereof for receiving one end of an elastically deformable member, which in the illustrated embodiment comprises a tension spring 72. The opposite end of this tension spring 72 is affixed as by a suitable fastener 74 to a selected point in the front wall 62 of the housing 60. The positioning of the fastener 74 is chosen so as to leave the tension spring 72 in an relaxed or undeformed state when the lever 28 is undeflected by an egg passing thereunder.

In this condition, it will be noted that the rod 52 is resting upon the upper edges of the trough 24.

Figure 3:
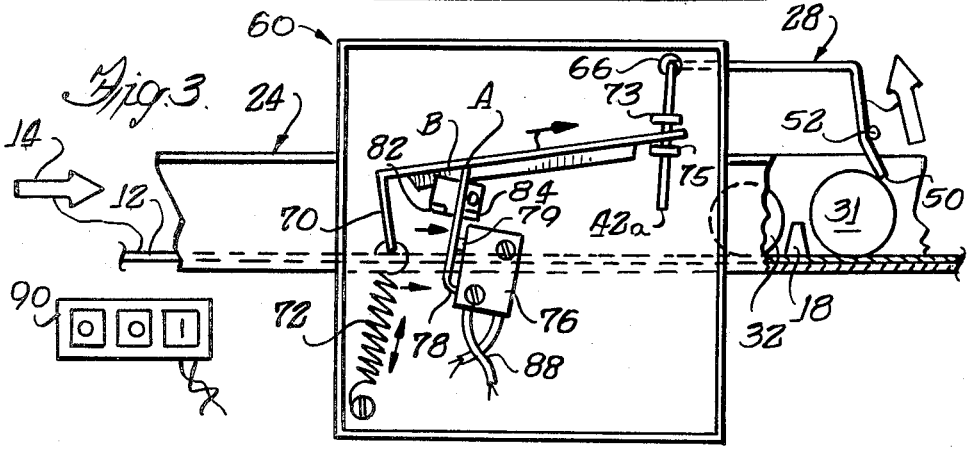
FIG. 3 is a partially cut away rear view, similar to FIG. 2, illustrating further features of the operation of the apparatus of the invention.

In FIG. 3, a relatively large egg 31 is indicated upwardly deflecting the lever 28 to a sufficient extent to cause the bar portion 42*a* to also fulcrum about the aperture 66 so as to draw the bar or slide 68 generally to the right somewhat as viewed in FIG. 3. This generally rightward movement of the slide 68 as illustrated in FIG. 3 is sufficient to actuate the switch 76. This switch 76 includes an actuating bar or lever 78 which is positioned for actuating, or de-actuating a pushbutton 79 of the switch 76. In the illustrated embodiment the switch 76 is of the momentary contact type. The lever 78 is positioned in sliding frictional engagement with the slide 68 at all times so as to be moved in either direction in response to movement of the bar or slide 68 in either direction, to the right or to the left as viewed in FIGS. 2 through 6.

Preferably, the strip or slide 68 is mounted at an acute angle 69 to the horizontal. This is accomplished by slidably engaging the slide 68 and a right angled edge 68*a* thereof with the top edges of the switch actuating lever 78, while mounting the end of the slide 68 to the rod 42*a* at a point somewhat higher. A pair of stops 73, 75 are provided on the rod 42*a* for positioning the slide 68 in this fashion. Preferably the stops 73, 75 frictionally engage the rod 42*a* so as to be selectively positionable along its length.

It will be noted that only a relatively small amount of upward deflection of the lever 28 is necessary to cause sufficient movement of the slide 68 for actuating the switch 76. Regardless of the size of the egg 31, further upward deflection of the rod 28, for example, as viewed in FIG. 4, will merely cause the slide 68 to continue to slide across the top of the switch lever 78, once the switch 76 has been actuated thereby. Hence, the size of an egg 31 which may pass by the lever 28 is not limited by the switch 76, but only by the force of the tension spring 72 opposing such movement and of course, the maximum deflection of the lever 28 and of the rod 42*a*. The tension spring 72 is placed in tension and expands somewhat in response to the deflection of the lever 28 and rod due to the passage of the egg 31.

Further in this regard, a slotted angle bracket 80 is mounted by suitable fastener 81 to provide a pair of stop surfaces 82, 84 for defining the maximum movement in either direction of the switch actuating lever 78. Hence, when the lever 78 abuts the stop 82, the switch 76 is in its unactuated condition. Conversely, when the lever 78 abuts the stop 84, the switch 76 is in its actuated condition. Moreover, the slide 68 will continue to slide over the lever 78 (if there is further movement of the slide 68), having no further effect thereupon, once the lever 78 has reached either of these stops 82, 84 in response to movement of the slide 68 in the corresponding direction.

Figure 4:
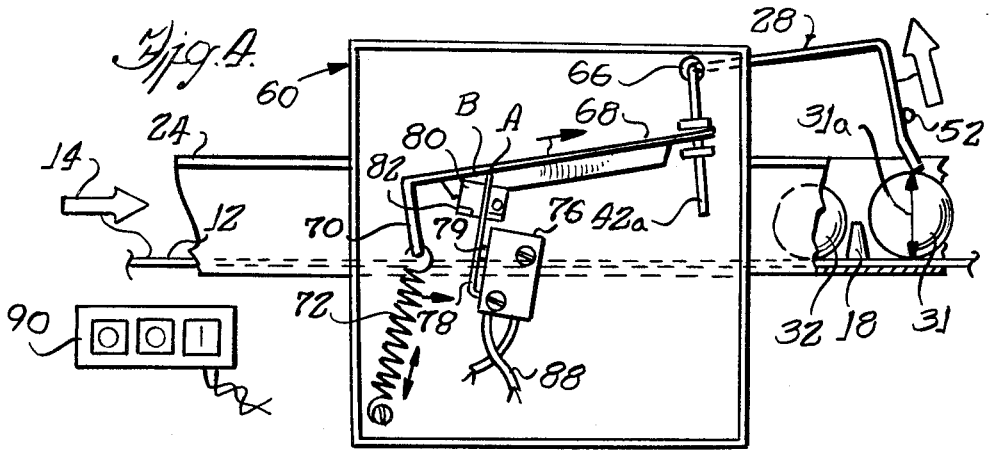
FIGS. 4 through 6 are partially cut away view, similar to FIG. 2 and FIG. 3, illustrating still further features of the operation of the apparatus of the invention.

The foregoing will be appreciated by observing the movement of two fixed points A and B of the slide 68 relative to the switch actuating lever 78 through the successive positions illustrated in FIG. 2 through FIG. 6. Hence, in FIG. 2, the point A on the slide 68 engages the switch actuating lever 78 and this point A pulls the lever 78 to the position shown in FIG. 3, until the lever 78 abuts the stop 84. Thereafter, as seen in FIG. 4, the slide 68 slides relative to the lever 78 until the maximum deflection of the lever 28 is reached, due to the passage of the largest portion 31*a* of the egg 31. At this juncture, point B of the slide 68 has come into contact with the lever 78.

Figure 5:
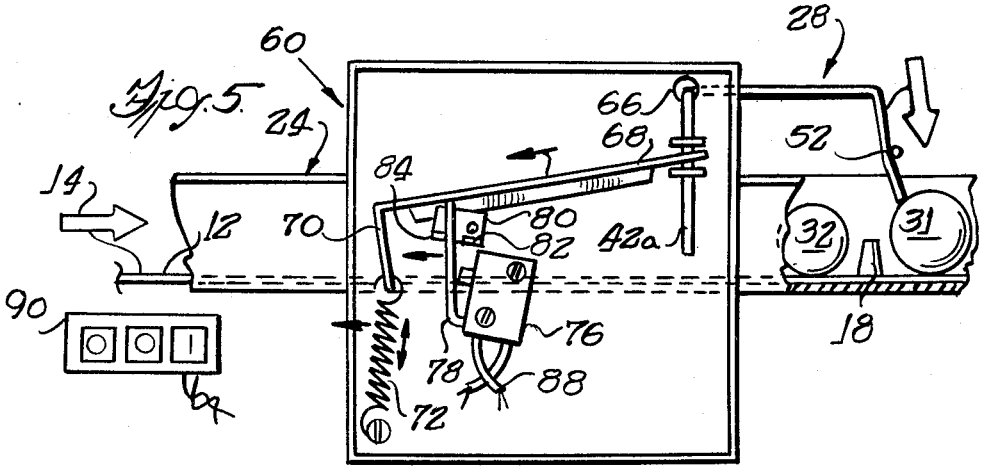

Moreover, because of the tension thus placed on the spring 72, when the greatest cross-sectional area of the egg 31 (see FIG. 4) has passed the lever 28, the spring 72 will begin to draw the slide 68 back and hence the lever 28 downwardly (see FIG. 5). As best viewed in FIG. 5, when the lever 28 begins to again move downwardly towards its undeflected condition, the slide 68 will again be drawn back towards the left by the tension spring 72. It will be appreciated that only a relatively small incremental amount of movement in this direction is necessary to cause the frictionally engaged switch actuator bar or lever 78 to release the switch actuator button 79, thus returning the switch to its inactive state. Moreover, this release of button 79 occurs even before the lever 78 has reached the stop 82. In this regard, the switch may be of either the normally open or normally closed variety, and a suitable counter 90 may be provided which is responsive by way of leads 88 to either an open circuit condition or a closed circuit condition for advancing a count. However, in the illustrated embodiment the switch 76 is of the normally open, momentary contact variety. Comparing FIG. 4 and FIG. 5, it will be seen that the point B of the slide 68 remains engaged with the switch actuator lever 78 during this return or resetting movement.

From the foregoing, it will be seen that the lever 28, slide 68 and spring 72 are collectively disposed such that the switch 76 will be activated in response to an object such as an egg (e.g. 31) whose maximum height dimension (e.g. 31*a*) is only slightly greater than the spacing of the arm 50 of the lever 28 above the bottom of the conveyor 12. However, the resetting or deactivation of the switch 76 will take place in response to an amount of return movement of the same structure caused by only a small incremental decrease from the maximum deflection of the lever 28 in response to a given object or egg passing thereunder. That is, the reset point, as such, of the structure for actuating the switch 76 is not fixed but is, in effect, "floating". Thus, resetting of the switch in response to but an incremental decrease of the maximum deflection of the lever 28 in response to the passage of an object thereby is guaranteed over a relatively broad range of sizes of objects or eggs.

Figure 6:
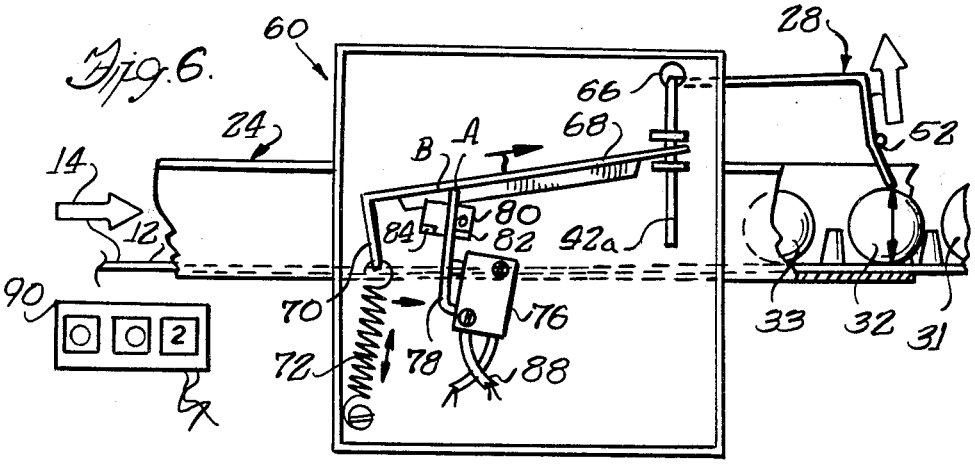

Referring to FIG. 6, the switch having been reset in FIG. 5 is now in a condition for again responding to even a relatively small egg 32 closely following the relatively large egg 31. In this regard, it will be appreciated that the structure momentarily returns to its rest position, as shown in FIG. 2, intermediate the positions illustrated in FIG. 5 and FIG. 6. Moreover, should even a second relatively large or even larger egg follow the egg 31, the switch mechanism has been reset by the slight incremental decrease in deflection of the lever (compare FIG. 4 and FIG. 5) following passage of the largest portion 31*a* of the egg 31, so that the switch is ready for response to the second egg whether large or small relative to the egg 31.

Additionally, with reference to FIG. 5 and FIG. 2 (which represents the position of the mechanism intermediate FIG. 5 and FIG. 6) continued movement of the slide 68 to the left initially results in return fo the switch lever 78 to the stop 82. Thereafter, further movement of the slide 68 to the left results in disengagement of point B from the lever 78. Eventually, as the slide 68 returns to its rest position shown in FIG. 2, the point A again comes into contact with the switch lever 78. Hence, in FIG. 6 the lever 78 is again moved to its actuated position, toward the stop 84 by its frictional engagement with the slide 68, at point A thereof. However, even if the egg 32 follows so closely as to prevent return to the rest position (FIG. 2), the switch will still be actuated to count the egg 32, because of the resetting action described above with reference to FIG. 4 and FIG. 5. Hence, in FIG. 6 the counter 90 registers count 2, in response to the egg 32.

Since the reset point of the apparatus is independent of the size of the objects such as eggs passing therethrough (at least over a given range which includes most conceivable sizes of poultry eggs) reliable counting of such eggs substantially without regard to their sizes or to the order in which they are presented to the apparatus of the invention is insured.

While the invention has been illustrated and described hereinabove with reference to a preferred embodiment, the invention is not limited thereto. Those skilled in the art may devise various alternatives, changes and modifications upon reading the foregoing descriptions. The invention includes such alternatives, changes and modifications insofar as they fall within the spirit and scope of the appended claims.

The invention is claimed as follows:

1. A counting apparatus comprising: signalling means for producing a detectable signal in response to passage of at least a portion of an object past a predetermined part of a predetermined path of travel, said signalling means being responsive to objects at least a portion of which is of a size over a predetermined range of sizes, and resetting means for resetting said signalling means following the production of each signal thereby so as to enable production of a further signal thereby in response to passage of a subsequent object past said predetermined part of said path of travel, said resetting means being responsive to a predetermined minimum incremental decrease in the size of the portion of said object at said predetermined part of said path of travel for resetting said signalling means, without regard for the actual size of the object or any portion thereof within said range of sizes.

2. A counting apparatus according to claim 1 wherein said signalling means comprises switching means having a first state and a second state and means for actuating said switching means to said first state in response to the passage of said at least a portion of an object past said predetermined part of said path of travel.

3. A counting apparatus according to claim 2 wherein said resetting means includes means for actuating said switching means to said second state.

4. A counting apparatus according to claim 3 wherein said switching means is mechanically actuatable and wherein said actuating means includes lever means interposed in said path of travel adjacent said predetermined part thereof and movable in response to passage of said at least a portion of an object thereby and coupling means for operatively coupling said lever means for actuating said switching means to said first condition.

5. A counting apparatus according to claim 4 wherein said resetting means is also operatively coupled for resetting said lever means.

6. A counting apparatus according to claim 4 wherein said resetting means comprises elastically deformable means operatively coupled with said lever means.

7. A counting apparatus according to claim 6 wherein said coupling means is further coupled intermediate said lever means and said elastically deformable means.

8. A counting apparatus according to claim 6 wherein said switching means includes second lever means disposed for actuating said switching means to said first state in response to movement of said coupling means a predetermined distance in a first direction and for thereafter actuating said switching means to said second state in response to movement of said coupling means a predetermined distance in a second direction opposite said first direction.

9. A counting apparatus according to claim 8 wherein said first lever means is operatively coupled for moving said coupling means in said first direction in response to the passage of said at least a portion of an object past said predetermined part of said path of travel and wherein said elastically deformable means is operatively coupled for moving said coupling means in said second direction in response to said predetermined minimum incremental decrease in the size of said portion of an object at said predetermined part of said path of travel.

10. A counting apparatus for producing a countable signal in response to each object moving past a predetermined point in a predetermined path of travel, comprising: lever means interposed in said path of travel substantially adjacent said predetermined point and movable in a first direction in response to passage of at least a portion of an object past said predetermined point, said portion being of a size which is within a predetermined range of sizes, signalling means having a first signal state and a second signal state, coupling means for operatively coupling said lever means with said signalling means for actuating said signalling means to said first signal state in response to movement of said lever means in said first direction, and resetting means operatively coupled with said lever means and with said signalling means for thereafter actuating said signalling means to said second signal state in response to a predetermined minimum incremental movement of said lever means in a direction generally opposite said first direction in response to a predetermined minimum incremental decrease in the size of a portion of said object passing by said predetermined point along said path of travel.

11. A counting apparatus according to claim 10 wherein said signalling means comprises switching means having a first state and a second state corresponding respectively to said first and second signal states and means for actuating said switching means to said first state in response to said coupling means and for actuating said switching means to said second state in response to said resetting means.

12. A counting apparatus according to claim 11 wherein said switching means is mechanically actuatable and wherein said actuating means includes further lever means.

13. A counting apparatus according to claim 12 wherein said resetting means comprises elastically deformable means operatively associated with said lever means and with said further lever means.

14. A counting apparatus according to claim 13 wherein said coupling means is coupled intermediate said lever means and said elastically deformable means.

15. A counting apparatus according to claim 13 wherein said further lever means is disposed for actuating said switching means to said first state in response to movement of said coupling means a predetermined distance in a first direction and for thereafter actuating said switching means to said second state in response to movement of said coupling means a predetermined distance in a second direction opposite said first direction.

16. A counting apparatus according to claim 15 wherein said first lever means is operatively coupled for moving said coupling means in said first direction in response to the passage of said at least a portion of an object past said predetermined part of said path of travel and wherein said elastically deformable means is operatively coupled for moving said coupling means in said second direction in response to said predetermined minimum incremental decrease in the size of said portion of an object at said predetermined part of said path of travel.

* * * * *